US005223883A

United States Patent [19]

Suzuki

[11] Patent Number: 5,223,883

[45] Date of Patent: Jun. 29, 1993

[54] DRYING DEVICE FOR AN AUTOMATIC DEVELOPING APPARATUS

[75] Inventor: Motoi Suzuki, Minami-Ashigara, Japan

[73] Assignee: Fuji Photo Film Co., Ltd., Kanagawa, Japan

[21] Appl. No.: 868,736

[22] Filed: Apr. 15, 1992

[30] Foreign Application Priority Data

Apr. 19, 1991 [JP] Japan ..... 3-88464

[51] Int. Cl.[5] ..... G03D 3/08

[52] U.S. Cl. ..... 354/320

[58] Field of Search ..... 354/298, 299, 323, 324, 354/300, 320; 34/18, 155, 156, 54, 41, 60

[56] References Cited

U.S. PATENT DOCUMENTS 5,097,605 3/1992 Kashino et al. ..... 354/300 X

FOREIGN PATENT DOCUMENTS 354560 3/1991 Japan .

*Primary Examiner*—D. Rutledge

*Attorney, Agent, or Firm*—Sughrue, Mion, Zinn, Macpeak & Seas

[57] ABSTRACT

A drying device for an automatic developing apparatus has a plurality of far infrared radiant heaters and fans provided in a squeezing portion, which is located between a processing area for a processing liquid and a drying area, for drying a film in accordance with a predetermined drying control pattern, in a constant-rate drying area until the film reaches a drying point. When the film is conveyed into the drying area, the film is dried by the plurality of far infrared radiant heaters and fans positioned in a first drying portion until the film moves from the constant-rate drying region to a predetermined decreasing-rate drying region. When the film is conveyed from the first drying portion to a second drying portion, a rate of change of a surface temperature of the film with respect to the drying time until the film reaches the drying point is maintained at a constant value. Thus, the drying process is completed without unsatisfactory drying and inconveniences such as drying marks. This permits the drying time of the film to be reduced, and permits the film to be dried optimally without unsatisfactory drying.

7 Claims, 6 Drawing Sheets

DRYING DEVICE FOR AN AUTOMATIC DEVELOPING APPARATUS

BACKGROUND OF THE INVENTION

1. Field of the Invention

The present invention relates to a drying device for an automatic developing apparatus.

2. Description of the Related Art

With advances in electronics, a rapid photographic process has been required in the field of silver halide photography. Particularly, a rapid process is required in processing some photosensitive materials such as sensitive material used for graphic arts, scanners and X-rays. The term "rapid process" as described herein means a process in which the amount of time from the time when an end of a photosensitive material is inserted into a photographic processor, i.e., an automatic developing apparatus, to the time when the end is removed from a drying area after the photosensitive material has passed through a processing area for developing, fixing and washing, and a drying area, is in a range of 20–60 seconds. In order to reduce this processing time, a velocity of the photosensitive material which is transported in the photographic processor is increased. However, only an increase of the conveying velocity results in inconveniences such as insufficient fixing and drying.

Accordingly, chemically effecting rapid process of the photosensitive material has been proposed. Such a process includes, for example, increasing the concentration of thiosulfate in a fixing liquid in order to accelerate a fixing velocity, or hardening the membrane of the photosensitive material in order to improve the drying characteristics of the photosensitive material.

However, although a hardening agent such as a water soluble aluminum compound must be included in a fixing liquid in order to fix the photosensitive material whose membrane is hardened, the hardening agent such as a water soluble aluminum compound works to decelerate the fixing speed. Therefore, if no hardening agent such as a water soluble aluminum compound is included at all in the fixing liquid, or if the amount of the hardening agent included therein is very small, a situation arises in which the drying characteristics of the photosensitive material may deteriorate because the swelling rate of an emulsion on the photosensitive material increases. Thus, few attempts to reduce the hardening agent such as a water soluble aluminum compound have been made since such a chemical approach for the rapid process has a deleterious effect on the fixing speed and the drying speed.

As a result, emphasis nowadays is put on accelerating the drying speed in a drying area of the automatic developing apparatus. These efforts have resulted in providing a hot-air blowing system and a hot-air blowing system with a far infrared radiant heater (Japanese Patent Application Laid-open No. 3-54560).

In the hot-air blowing system, a photosensitive material, after having had the water on its surface squeezed off in a squeezing portion of the automatic developing apparatus, is conveyed to a drying area. The surface of the photosensitive material is blown by hot air, thereby the photosensitive material is dried.

The photosensitive material to which this hot-air blowing system is applied has drying properties such that, as illustrated in FIG. 5(A), water content is evaporated from the surface of the photosensitive material at a constant rate by the supply of heat from hot-air blowing at an initial step of drying, while the surface temperature of the photosensitive material is constant. This condition is referred to as a constant-rate drying region A. Then, when the evaporation process is performed continuously after the constant-rate drying region A, water content is evaporated even from the emulsion layer of the photosensitive material which is referred to a decreasing-rate drying region B. In this region B, as the evaporation rate of water content becomes lower, the surface temperature of the photosensitive material rises higher. If excessive drying is rapidly performed by applying the excessively hot air to the photosensitive material, there exists the possibility of producing an area which is not suitably dried because only the surface of the photosensitive material is hardened even though a large amount of water remains inside of the emulsion layer of the photosensitive material, thereby causing a so-called drying mark. Accordingly, in order to sufficiently evaporate water from the inside of the emulsion layer in the decreasing-rate drying region B, it is necessary to maintain a fixed rate of change [(C2−C1)/T5] of the surface temperature (C) of the photosensitive material with respect to the drying time (T5). It is also necessary to restrict the quantity of heat in the hot air and to dry the photosensitive material in a predetermined time.

The surface temperature of the photosensitive material is shown as C1 in the constant-rate drying region A. After a predetermined period of time passes after the temperature rises up to C2 which is substantially the same temperature as that in the drying area, the photosensitive material is removed from the automatic developing apparatus. The point C2 to which the surface temperature in the photosensitive material rises, is referred to as drying point (D).

At the drying point (D), water content is evaporated to the extent that the treatment of the photosensitive material is of no problem, and the photosensitive material is dried to the extent that no uneven gloss occurs on the surface of the photosensitive material. Excessively drying the photosensitive material after the drying point (D) results in a difference in surface gloss of the emulsion layer of the overdried photosensitive material, thereby causing a drying mark.

Thus, in order to reduce the drying time (T) by taking the drying property of the photosensitive material into account, increasing the amount of heat in the constant-rate drying region A has been proposed. Correspondingly, as illustrated in FIG. 5(B), it has been suggested that the time during the constant-rate drying region A be reduced (T4<T3) and the drying time (T) in the drying area be reduced using a hot-air blowing system with a far infrared radiant heater.

However, even in the above-described system, it is necessary to keep a fixed rate of change [(C2−C1)/T5] of the surface temperature (C) of the photosensitive material with respect to the drying time (T5) in the range of from the boundary area of the constant-rate drying region A and the decreasing-rate drying region B, to the drying point so that insufficient drying and the like does not occur. Therefore, the drying time (T5) in the decreasing-rate drying region B cannot be reduced, thereby limiting the reduction in the drying time (T) in the drying area.

SUMMARY OF THE INVENTION

In view of the afore-mentioned facts, it is an object of the present invention to provide a drying device for an automatic developing apparatus which is capable of reducing the drying time of a photosensitive material without causing drying marks.

According to the present invention, a drying device for an automatic developing apparatus, which has a drying area for drying the photosensitive material processed by a processing liquid in a processing area, has a squeezing portion located at an upstream side of the drying area, for squeezing off excess water adhering to surfaces of the photosensitive material. The drying device also includes a drying means which radiates radiant heat onto the photosensitive material, a second drying means located in the drying area for blowing hot drying air onto the photosensitive material, a surface temperature sensing means for sensing a surface temperature of the photosensitive material, and a control means for controlling the second drying means in accordance with a predetermined drying control pattern and based on the surface temperature sensed by the surface temperature sensing means so that the photosensitive material can be dried.

The control means is used to control the second drying means, which radiates radiant heat onto the photosensitive material, in accordance with a predetermined drying control pattern and based on the surface temperature sensed by the surface temperature sensing means. Thus, the second drying means can dry the photosensitive material conveyed to the drying area, in a range of a constant-rate drying region until the photosensitive material reaches a predetermined portion of a decreasing-rate drying region. In this case, the control means, which controls the drying means in accordance with the predetermined drying control pattern, is also used to keep a rate of change of the surface temperature of the photosensitive material with respect to the drying time, between a point at which the photosensitive material reaches the decreasing-rate drying region and the drying point, to be a predetermined value.

This permits the short-time drying of the photosensitive material, and allows the photosensitive material to be dried optimally without causing unsatisfactory drying, such as over-drying or underdrying, even though drying conditions, such as the percentage of water content of the photosensitive material due to differences in types of photosensitive material and in processing conditions thereof, and the temperature and the humidity in outside air introduced as drying air, may respectively vary each time the photosensitive material is processed. By applying the drying device for an automatic developing apparatus of the present invention to a photosensitive material processing unit, the photosensitive material may be processed using a fixing liquid containing substantially no hardening agent such as water soluble aluminum salt. The "processing by a fixing liquid containing substantially no hardening agent" described herein is provided so as not to form a hard membrane in the coating layer of the photosensitive material immersed in a fixing liquid, and more specifically, it indicates that a water soluble aluminum salt added to the fixing liquid shall be 0.01 mol/l or below. This permits the fixing of the photosensitive material in a short-time and improves the efficiency in washing, thereby reducing discoloration in the photosensitive material after the photosensitive material is processed.

The present invention can be applied not only to photosensitive materials used for printing, but also to various photosensitive materials used for X-rays, general negative, general reversal, general positive, direct positive and the like.

The silver halide emulsion used for the photosensitive material may include, as silver halide, chemical components such as silver bromide, silver iodobromide, silver chloride, silver chlorobromide, silver iodo-chlorobromide used in an ordinary silver halide emulsion. Silver halide grains may be obtained by either an acid process, a neutral process, or an ammonia process. Also the silver halide grains may have uniform distribution of silver halide composition therein, or may include core/shell grains, wherein the inner part of a grain differs from the surface layer in the composition of silver halide. The silver halide grains may be formed so as to have latent images mainly on their surfaces, or mainly within the grains.

Further, the silver halide grains may take any shape. In one preferred example, there exists a cubic shape having one-hundred crystal faces. Also, by employing methods described in U.S. Pat. No. 4,183,756 and U.S. Pat. No. 4,225,666, Japanese Patent Application Laid-open No. 55-26589, Japanese Patent Publication No. 55-42737, and The Journal Of Photographic Science, 21-39 (1973) and the like, grains each having shapes of octahedrons, dodecahedrons, or fourteen-faced solids can be formed and used. In addition, grains each having twin planes may be used.

Also, silver halide grains having a single shape may be employed, or grains of various shapes may be used.

In a case of a photosensitive material used for printing, a monodisperse emulsion is preferable. For monodisperse silver halide grains in the monodisperse emulsion, it is preferable that the weight of silver halide in the particle size range of $\pm 10\%$, with the mean particle size r as a central point, is 60% or more of the entire weight of silver halide grains.

The silver halide grains to be used for a silver halide emulsion, while being formed and/or being grown, may contain metal ions to be added by cadmium salt, zinc salt, lead salt, thallium salt, iridium salt, rhodium salt, iron salt or complex salt within and/or on the surface of each grain.

For the photographic emulsion used for the present invention, reduction sensitization using reduced materials, noble metal sensitization using noble metal compounds and the like may be used, in addition to sulfur sensitization and gold and sulfur sensitization.

A single photosensitive emulsion may be used, or two or more types of emulsion described above may be mixed.

In carrying out the present invention, after chemical sensitization as described above is effected, various types of stabilizers such as 4-hydroxy-6-methyl-1, 3, 3*a*, 7 tetrazaindene, 5-mercapto-1-phenyltetrazole, 2-mercaptobenzothiazole, etc. may be used.

Further, if required, a silver halide solvent, such as thioether, or a crystal habit control agent, such as compounds containing a mercapto group and a sensitizing dye, may be employed.

In particular, for a photosensitive material for printing, a "contrasting agent" such as tetrazolium compound, a hydrazine compound, or a polyalkylene oxide compound may be added.

The photographic emulsion for a silver halide photosensitive material may be sensitized spectrally into a relatively long wave blue light, green light, red light or infrared light by a sensitizing dye. Cyanine dye, merocyanine dye, composite cyanine dye, composite merocyanine dye, holopolarcyanines, hemicyanine dye, styryl dye and hemioxonoles and the like can be used. These sensitizing dyes may be used singly or in combinations. The combination of sensitizing dyes is often used for the purpose of supersensitization.

The silver halide photosensitive material may contain a water soluble dye to be used as a filter dye on the hydraulic colloid layer, or in order to prevent irradiation of halation, or for various other purposes. These dyes include an oxonol dye, hemioxonol dye, styryl dye, merocyanine dye, cyanine dye, azo dye, and the like. In particular, oxonol dye, hemioxonol dye and merocyanine dye are more effective. Examples using such dyes are disclosed in West German Patent No 616,007, British Patents No. 584,609 and No. 1,117,429, Japanese Patent Publications No. 26-7777, No. 39-22069, No. 54-38129, Japanese Patent laid-open No. 48-85130, No. 49-99620, No. 49-114420, No. 49-129537, PB Report No. 74175, Photographic Abstract 128 ('21) and the like.

In particular, it is desirable to use these dyes for photosensitive material for white light contact work. The silver halide photosensitive material according to the present invention may be processed by mordanting with a cationic polymer and the like when a hydraulic colloid layer of the silver halide photosensitive material contains dyes, ultraviolet ray absorbent and the like.

For the above-mentioned photographic emulsions, various types of compounds may be added in order to prevent deterioration of the sensitivity and the photographic fog of the silver halide photosensitive material while the silver halide photosensitive material is being manufactured, being preserved, or being processed.

Further, a technique for improving dimensional stability may be also be used in which a silver halide emulsion layer and a backing layer contain a polymer latex. Such a technique is described in Japanese Patent Publications No. 39-17702 and No. 43-13482, etc.

Although gelatin is used as the binder of the photosensitive material according to the present invention, a gelatin derivative, a cellulose derivative, a graft polymer of gelatin and other high polymers, all other proteins, a sugar derivative, and a hydraulic colloid, such as a synthetic hydraulic high polymer material like a simple substance or copolymer, can also be employed together.

In order to accomplish further objects, various types of additives can be used for the photosensitive material of the present invention. These additives are described in the Research Disclosure, Vol. 176, Item 17643 (December, 1978) and Vol. 187, Item 18716 (November, 1979) in more detail. The related portions are described below.

| Type of Additive | RD17643 | RD18716 |
|---|---|---|
| 1. Chemical sensitizer | page 23 | page 648, right column |
| 2. Sensitizing agent | | same as above |
| 3. Spectral sensitizer, Super sensitizer | pages 23–24 | from page 648, right column to page 649, right column |
| 4. Brightners | page 24 | |
| 5. Antifoggant, Stabilizer | pages 24–25 | page 649, right column |
| 6. Light absorbent, Filter dye ultraviolet ray absorbent | pages 25–26 | from page 649, right column to page 650, left column |
| 7. Stain remover | page 25, right column | page 650, left to right column |
| 8. Dye image stabilizer | page 25 | |
| 9. Hardening agent | page 26 | page 651, left column |
| 10. Binder | page 26 | same as above |
| 11. Plasticizer, Lubricant | page 27 | page 650, right column |
| 12. Coating aid, Surface active agent | pages 26–27 | same as above |
| 13. Static inhibitor | page 27 | same as above |

The base material used for the photosensitive material includes a flexible reflected base material, such as laminated sheets and synthetic paper of α-olefinpolymer (i.e., polyethylene, polypropylene, ethylene/butane copolymer), a film consisting of semi-synthetic or synthetic high polymer such as cellulose acetate, cellulose nitrate, polystyrene, polyvinyl chloride, polyethylene terephthalate, polycarbonate, polyamide, a flexible base material providing reflecting layers on such films metal, etc.

Among the above, polyethylene terephthalate is more desirable.

Examples of under-coating layers are disclosed in Japanese Patent Laid-open No. 49-3972, showing undercoating processed layers including an organic solvent containing polyhydroxybenzene class, and in Japanese Patent Laid-opens No. 49-11118 and No. 52-104913 both showing an undercoating processed layer of drainage texture latex.

In addition, the surfaces of the undercoating layers can be processed chemically and physically. Such a process comprises a surface active processing such as a chemical treatment, mechanical treatment, corona discharge treatment, and the like.

DESCRIPTION OF THE PREFERRED EMBODIMENTS

Schematic Construction of an Automatic Developing Apparatus

Figure 1:
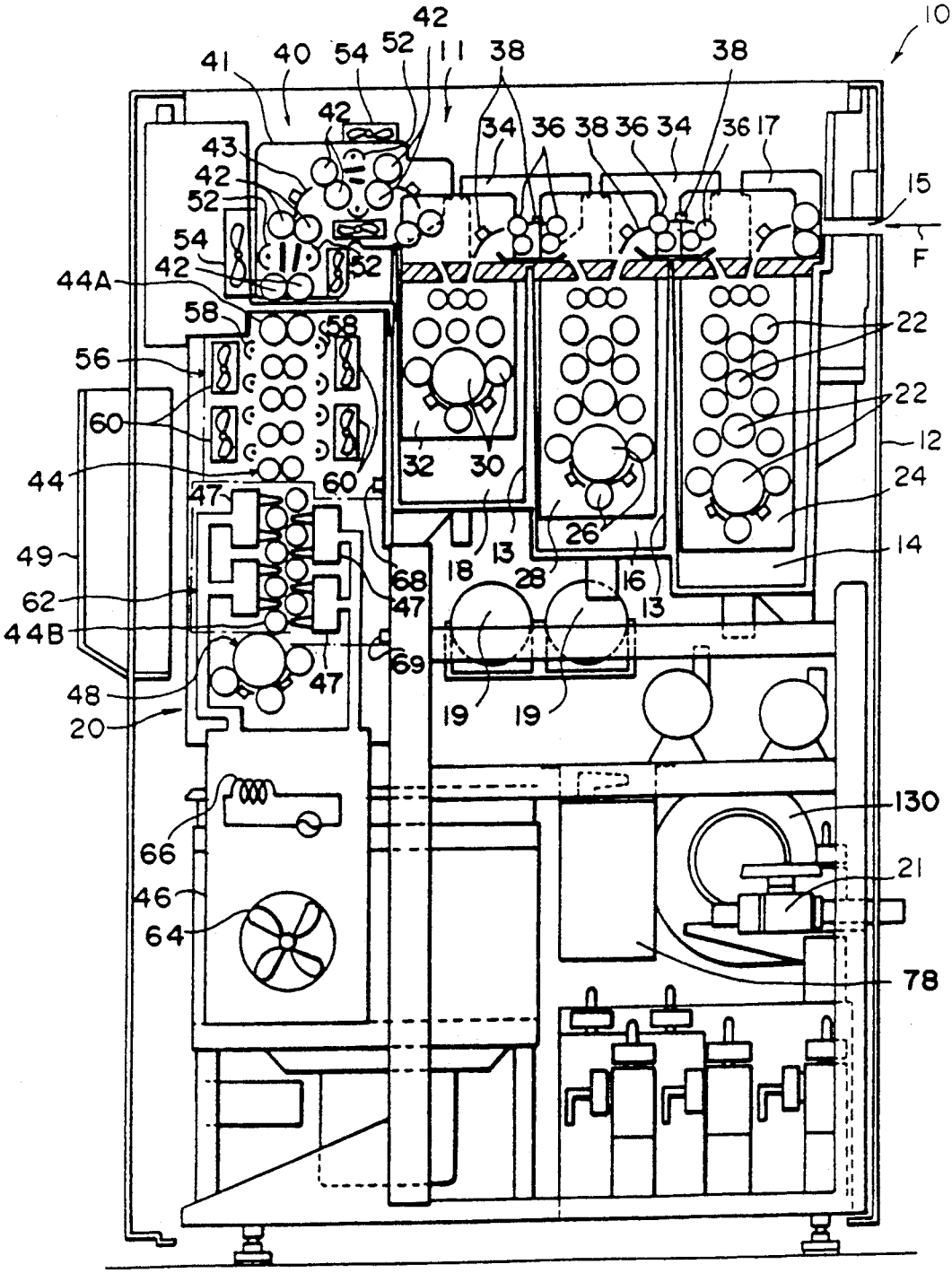
FIG. 1 is a schematic structural view of an automatic developing apparatus to which the present invention is applied.

Referring to the accompanying drawings, an automatic developing apparatus 10, to which the present invention is applied, is explained. As illustrated in FIG. 1, the automatic developing apparatus 10 is provided with a processing area 11 for a processing liquid and a drying area 20 within a machine casing 12. The processing area 11 for a processing liquid is provided with a developing tank 14, a fixing tank 16 and a washing tank 18 separated by partition plates 13 along a direction in which a photosensitive material (hereinafter referred to as "a film F") is conveyed.

In the neighborhood of an insertion opening 15 for the film F in the automatic developing apparatus 10, an inlet rack 17 is located, which inserts the film F into the automatic developing apparatus 10.

At the insertion opening 15 of the automatic developing apparatus 10, an insertion rack for manually inserting the film F for an automatic feeder for automatically inserting the film F by a conveying means, and the like can be attached. This automatic developing apparatus 10 can process the film F of a width ranging from 20 mm to 2000 mm, preferably a width from 35 mm to 1310 mm.

The developing tank 14, accommodating a developer, is provided with a conveyor rack 24 which has conveyor rollers 22 driven by a motor (not shown) and conveying the film F. The conveyor rack 24 is positioned so as to be immersed in the developer. The fixing tank 16, accommodating a fixing liquid, is provided with a conveyor rack 28 having conveyor rollers 26 driven by a motor (not shown) and conveying the film F. The conveyor rack 28 is positioned so as to be immersed in the fixing liquid. The washing tank 18, accommodating a washing liquid, is provided with a conveyor rack 32 having conveyor rollers 30 driven by a motor (not shown) and conveying the film F. The conveyor rack 32 is positioned so as to be immersed in the washing liquid.

Heat exchangers 19 are located respective below the developing tank 14 and the fixing tank 16. The developer in the developing tank 14 and the fixing liquid in the fixing tank 16 are conveyed to the respective heat exchangers 19. After heat is exchanged therein, the developer and the fixing liquid are returned to their respective tanks. In this manner, the liquid temperatures of the developer in the developing tank 14 and the fixing liquid in the fixing tank 16 are maintained within predetermined limits. Further, gas and water vapor generated in these processing areas is discharged from the automatic developing apparatus 10 by an exhaust fan.

The liquid exchange rate and the flow velocity of the surface of the liquid can expressed by the following formulas.

Liquid exchange rate
= [Flow of a pump (L/min)/Capacity of a tank (L)] × 100 (%)
Flow velocity of the surface of the liquid
= Flow (L/min)/Area of a pump channel ($mm^2$)
= (100 × flow)/[$\pi$ × (radius of pump channel)$^2$] (m/min)

Further, the liquid exchange rate and the flow velocity of the surface of the liquid in the developer and the fixing liquid are respectively defined as follows.

*Liquid exchange rate:
(Developer) 20 — 250%, preferably 60 — 220%
(Fixing liquid) 20 — 250%, preferably 70 — 210%
*Flow velocity of the surface of the liquid:
(Developer) 20 — 250% (m/min), preferably 30 — 190 (m/min)
(Fixing liquid) 20 — 250 (m/min), preferably 30 — 130 (m/min)

Above the developing tank 14, the fixing tank 16 and the washing tank 18, a crossover rack 34 is disposed between the developing tank 14 and the fixing tank 16, and another crossover rack 34 is disposed between the fixing tank 16 and the washing tank 18. These crossover racks 34 are each provided with holding/conveyor rollers 36, which convey the film F from an upstream tank to a downstream tank in the direction in which the film F is conveyed, and guides 38, which guides the film F.

Therefore, the film F inserted into the automatic developing apparatus 10 through the insertion opening 15 is inserted into the developing tank 14 at an insertion rack 17 and conveyed through the developer by the conveyor rollers 22, so that the film F can be developed. The developed film F is transferred to the fixing tank 16 by the crossover rack 34 and conveyed through the fixing liquid by the conveyor rollers 26, so that the film F can undergo a fixing process. Further, the fixed film F is transferred to the washing tank 18 by another crossover rack 34 and conveyed through the washing liquid by the conveyor rollers 30, so that the film F can be washed.

At bottom portions of the developing tank 14, the fixing tank 16 and the washing tank 18, drain tubes (not shown) are respectively provided. A drain valve 21 is respectively attached to each of the bottom portions. Consequently, when these drain valves 21 are opened as needed, the developer in the developing tank 14, the fixing liquid in the fixing tank 16 and the washing liquid in the washing tank 18 can be discharged respectively.

CONSTRUCTION OF A SQUEEZING PORTION

Next, the construction of a squeezing portion 40 to which the drying device for the automatic developing apparatus according to the first embodiment of the present invention is applied is described herein.

The squeezing portion 40 is positioned between the washing tank 18 and the drying area 20. The squeezing portion 40 is formed of a squeezing rack 41 with conveyor rollers 42 squeezing and conveying the film F, to which water is adhering and which is conveyed from the washing tank 18, to the drying area 20, and a guide 43 guiding the film F. Between these conveyor rollers 42 conveying the film F in the horizontal and vertical directions, a pair of far infrared radiant heaters 52, which is capable of radiating radiant heat to both sides of the film F, is located respectively on both sides of the conveying path of the film F. Also, at sides opposite the radiating directions of the far infrared radiant heaters 52, fans 54 are respectively provided for blowing drying air uniformly upon the surfaces of the film F. Very humid air within the squeezing portion 40 is discharged out of the apparatus by an exhaust fan 130 through a duct (not shown).

CONSTRUCTION OF A DRYING AREA

The drying area 20 is provided with conveyor rollers 44 for conveying the film F along the vertical direction. A plurality of pairs of far infrared radiant heaters 58, which are capable of radiating radiant heat upon both sides of the film F, is located respectively on both sides of the conveying path of the film F along the vertical direction in a first drying portion 56 within the drying area 20. Also, a plurality of fans 60 are respectively provided at sides opposite the radiating directions of the far infrared radiant heaters 58 so that the fans 60 can blow drying air uniformly upon the surfaces of the film F. Also, axial-flow fans or cross-flow fans may be used as fans 54 and 60.

A plurality of spray pipes 47 blowing drying air to the film F is positioned on both sides of the conveying path of the film F in a second drying portion 62 provided at a downstream side of the first drying portion 56 of the drying area 20. The supply of drying air to these spray pipes 47 is carried out by a drying fan 64, which supplies drying air and is located below the drying area 20, and by a chamber 46 with a heater 66 for heating the drying air. The time in which the film F passes through the drying area 20, i.e., the drying time (T), is defined by the linear velocity of the film F (the conveying speed of the film F in mm/s) and the length of the conveying path through the drying area 20 (the distance between a conveyor roller 44A and a conveyor roller 44B in mm). In this embodiment of the present invention, the required time from the time the film F enters the squeezing portion 40 until the drying process of the film F is finished can be set in the range of 2–30 seconds, but preferably in the range of 3–15 seconds. The results in this embodiment are that an optimum drying time is 6 seconds at a linear velocity of 2200 mm/s and a path length, in the drying area in which the far infrared radiation is radiated, of 220 mm, and another optimum drying time is 6 seconds at a linear velocity of 7800 mm/s and a path length therein of 700 mm.

Figure 6:
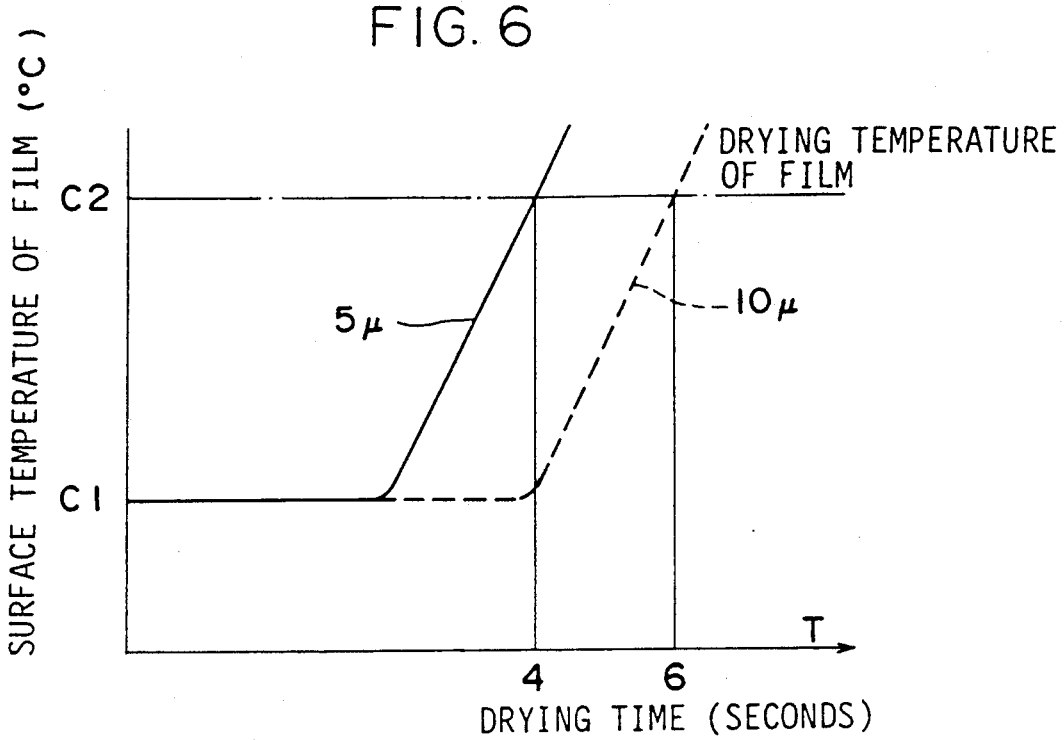
FIG. 6 is a graphic representation showing drying conditions in accordance with the characteristic conditions of film.

Further, FIG. 6 illustrates the drying conditions in accordance with the drying characteristics of the film F. Using a far infrared radiant heater with 1200 W capacity, it is most suitable to dry the film F in six seconds when an increased thickness of an emulsion layer of the film F, by swelling after being washed, is 10$\mu$. Also using a far infrared radiant heater with 1200 W capacity, it is most suitable to dry the film F in four seconds when an increases thickness is 5$\mu$.

Figure 7:
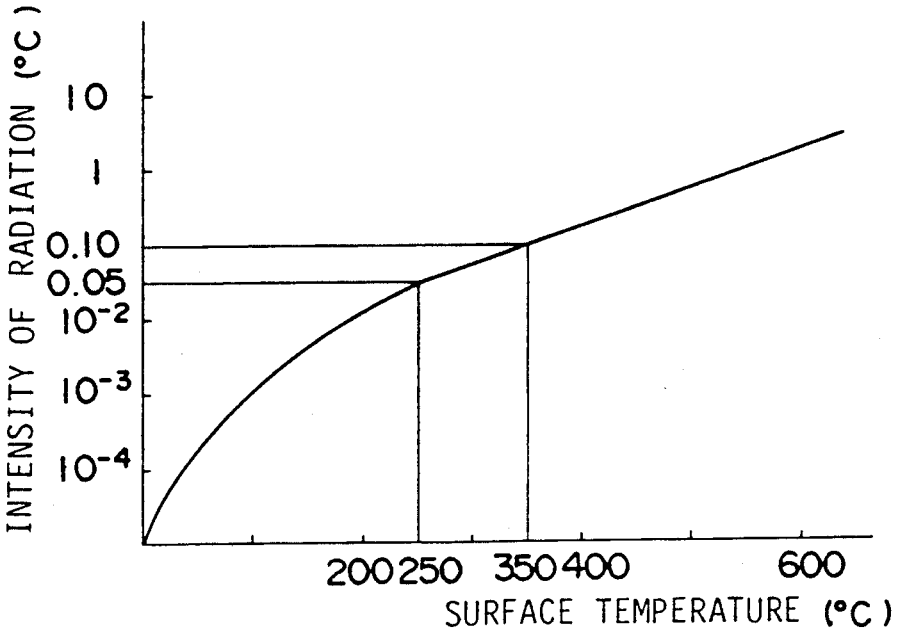
FIG. 7 is a graphic representation showing irradiation conditions of far infrared radiant heaters.

The intensity of radiation of the far infrared radiant heaters utilized in the present invention, as indicated in FIG. 7, is 0.1 W/cm$^2$ when surface temperatures of two pairs of far infrared radiant heaters are 350° C., and is 0.05 W/cm$^2$ at surface temperatures of 250° C.

Finally, a drying turn portion 48 conveying the film F in an obliquely upward direction is located in a lowermost part of the second drying portion 62. A receiving box 49, which accommodates the film F transferred from the drying turn portion 48, is provided on the outside wall of the automatic developing apparatus 10.

CONTROL UNIT IN THE DRYING AREA

Surface temperature sensors 68, 69, each sensing the surface temperature of the film F, are located respectively in the first drying portion 56 and the second drying portion 62.

Figure 3:
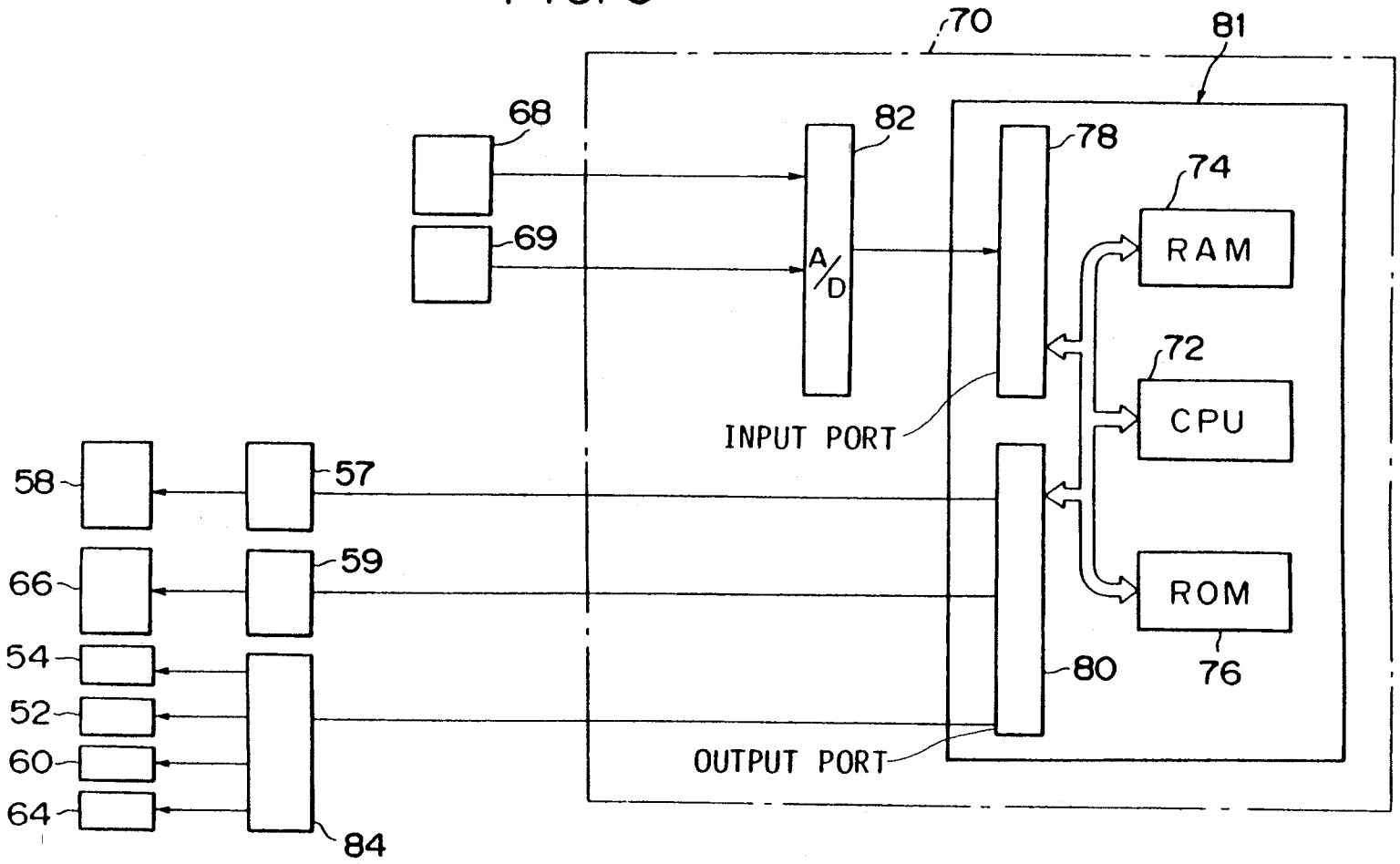
FIG. 3 is a block diagram showing a control method of a drying device of an automatic developing apparatus according to the present invention.

As illustrated in the block diagram of FIG. 3, the surface temperature of the film F detected by the surface temperature sensors 68, 69 is entered in a control unit 70, in order to control the heating temperatures of the far infrared radiant heater 58 and a heater 66.

The control unit 70 includes a microcomputer 81 having a CPU 72, a RAM 74, a ROM 76, an input port 78 and an output port 80. The control unit 70 also includes an A/D converter 82 converting an analog signal to a digital one.

The A/D converter 82 is connected to the input port 78, and the surface temperature sensors 68, 69 are connected through the A/D converter 82 to the input port 78. The far infrared radiant heater 58 and the heater 66 are connected to the output port 80 through the respective drivers 57, 59, so as to be controlled by the microcomputer 81. Also, the far infrared radiant heater 52 and fans 54, 60, 64 are connected through a driver 84 to the output port 80.

Accordingly, the quantity of radiant heat supplied to the first drying portion 56 and the temperature of drying air supplied to the second drying portion 62 can be controlled by the control unit 70.

Figure 2:
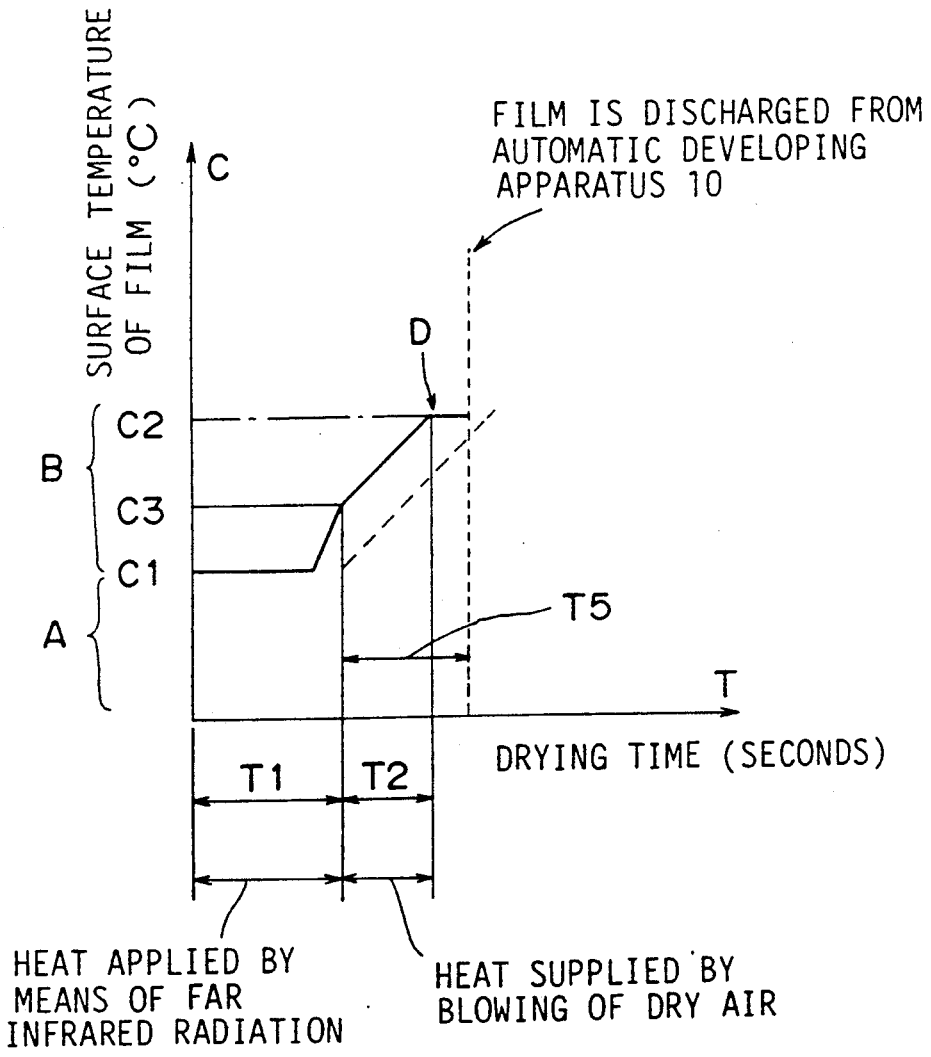
FIG. 2 is a graphic representation of a drying control pattern according to an embodiment of the present invention.

In the ROM 76, drying control patterns for drying the film F optimally are stored. Each drying control pattern represents the relationship of the driving time (T) within the drying area 20 and the surface temperature (C) of the film F, as illustrated in FIG. 2. One control pattern is read out from the ROM 76 by a pair of surface temperature sensors 68, 69 and stored in the RAM 74. This data (control pattern) is transmitted to the control unit 70 and used for the next drying of the next photosensitive material.

The operation of the present invention will be explained hereinafter.

First, the exposed film F is inserted from the insertion opening 15 into the automatic developing apparatus 10. The film F is processed by developer, fixing liquid and washing liquid in the developing tank 14, fixing tank 16 and washing tank 18, respectively. The film F is then conveyed at a certain linear velocity to the squeezing portion 40 to be squeezed (see FIG. 1).

In this case, the film F, which is conveyed at a certain linear velocity, is dried by the radiant heat radiated from the far infrared radiant heaters 52 and by air blown from the fans 54 located in the squeezing portion 40. However, the surface temperature (C1) of the film F is maintained at a certain value (see FIG. 2) since the film F is not dry, i.e., at the constant-rate drying region A. Next, the film F is conveyed, in such a condition, to the first drying portion 56 of the drying area 20. Thus, before being conveyed to the drying area 20, the film F can be dried at the same time as the film F is squeezed at the squeezing portion 40, thereby quickly removing water adhering to the surface of the film F and reducing the overall drying time (T).

The water on the film F, which is conveyed to the first drying portion 56, can be evaporated by the radiant heat radiated from the far infrared radiant heaters 58 and by air blown from a fan 60, so that the film F can be dried. The air flows away the evaporated vapor on the surface of the film F.

When the film F is further heated in the first drying portion 56, as illustrated in FIG. 2, the film F moves from the constant-rate drying region A to the decreasing-rate drying region B. Then, water is evaporated from the emulsion layer on the surface of the film F, with the result that the surface temperature of the film F rises to the temperature of C3. These heaters 58 are controlled by the data stored in the RAM 74.

Next, the film F, which has moved into the decreasing-rate drying region B, is conveyed from the first drying portion 56 to the second drying portion 62. In this case, the film F is dried by drying air blown from the plurality of spray pipes 47 while being conveyed by the conveyor rollers 44. However, as illustrated in FIG. 2, the rate of change of the surface temperature (C) of the film F with respect to the drying time (T) up to the drying point (D), i.e., $(C2-C3)/T2=V$, is controlled to a certain value. Additionally, after reaching the drying point (D), the film F is transported out from the second drying portion 62 and accommodated in the receiving box 49 through the drying turn portion 48.

Consequently, in accordance with the drying device of this embodiment, not only is the drying time in the constant-rate drying region A reduced, but also, the drying time in the decreasing-rate drying region B can be reduced since the film F is dried such that the rate of change of the surface temperature (C) of the film F with respect to the drying time (T) up to the drying temperature (C2), corresponding to the drying point (D), is maintained at a certain value. Further, the film F can be dried optimally without causing poor drying , such as over-drying, which results in the emulsion of the film F being hardened, or underdrying, due to excess water adhesion, which results in the film F being unmanageable. The film F being dried optimally can thereby considerably reduce processing time in the automatic developing apparatus 10.

The squeezing portion 40 is provided with the far infrared radiant heaters 52 and the first drying portion 56 is provided with the far infrared radiant heaters 58 in this embodiment of the present invention. However, the drying time in the constant-rate drying region A can be reduced even when the squeezing portion 40 of the conventional automatic developing apparatus, in which only hot air is supplied, is only provided with the far infrared radiant heaters 52. Also, dividing the drying area 20 into two drying portions is not absolutely necessary. The far infrared radiant heaters 58 and the fans 60 may be located throughout the drying area 20 to enable the dry processing.

Figure 4:
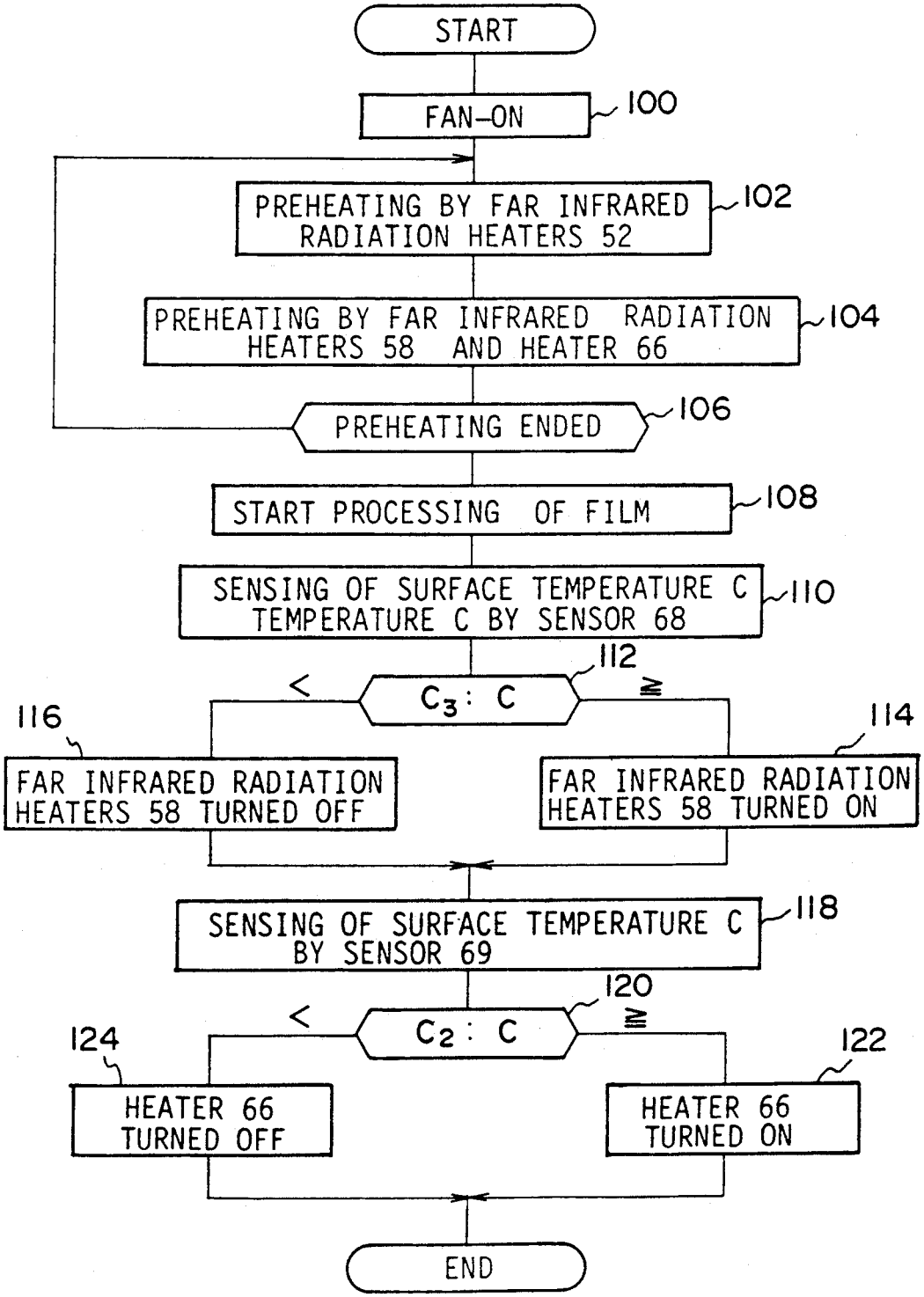
FIG. 4 is a control flow chart according to an embodiment of the automatic developing apparatus of the present invention.
Figure 5A:
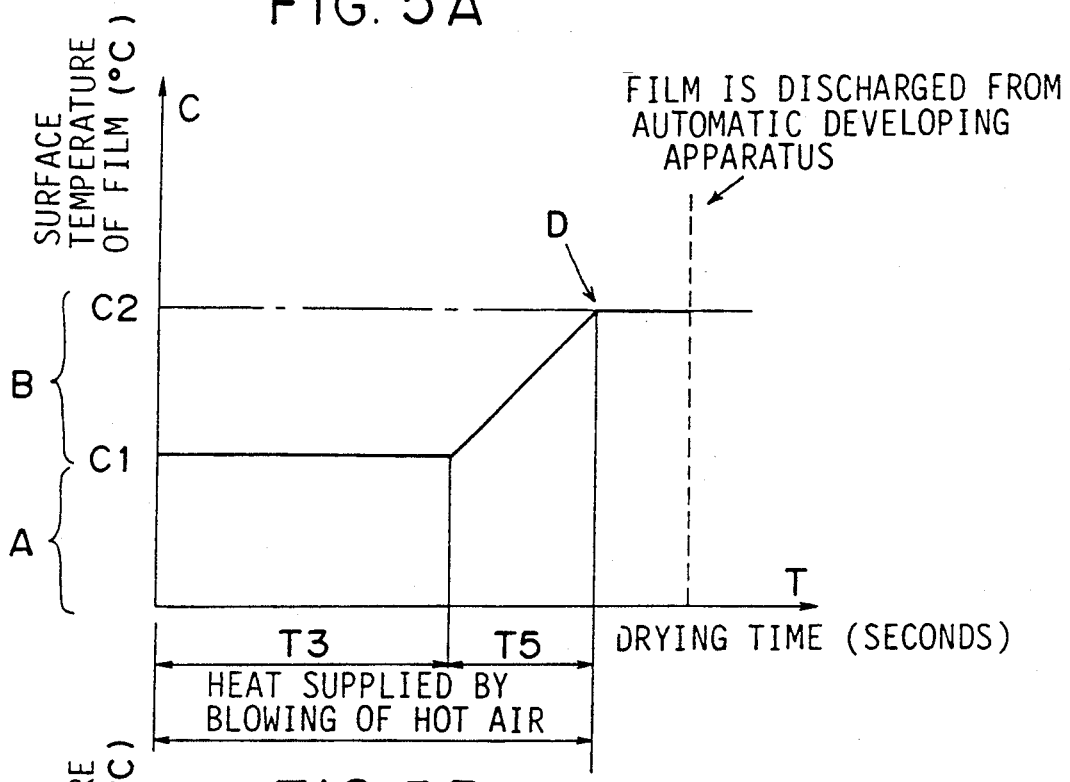
FIGS. 5(A) and 5(B) are graphic representations showing drying control patterns of conventional automatic developing apparatus.
Figure 5B:
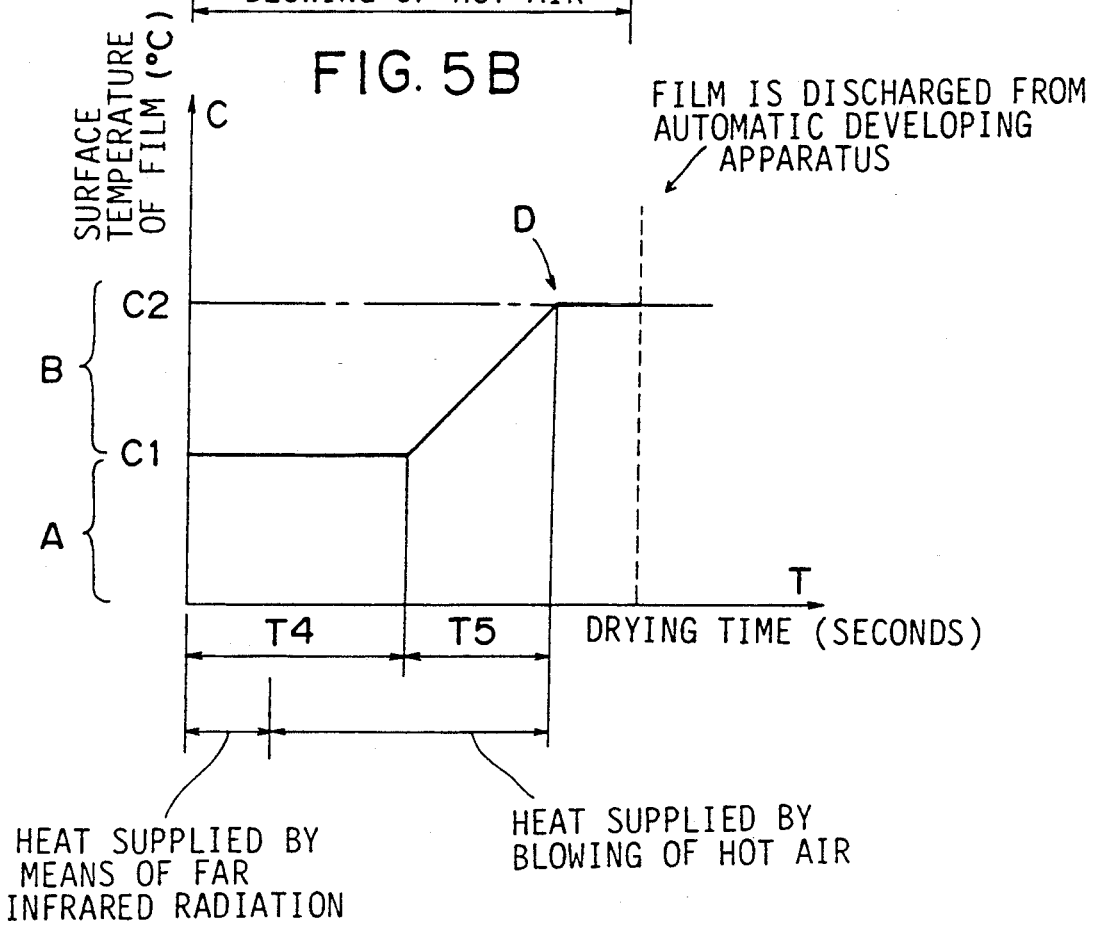

The control executed by the control unit 70 will now be explained with reference to the flow chart of FIG. 4.

When the power switch of the automatic developing apparatus 10 is turned on, a program is started. In a step 100, fans 54, 60 and 64 are activated. In a step 102, the far infrared radiant heaters 52 located in the squeezing portion 40 are heated based on a predetermined drying control pattern so that the squeezing portion 40 can be preheated. Next, in a step 104, on-off controlling of a heater 66 and the far infrared radiant heaters 58, which is similarly based on the predetermined drying control pattern, allows the drying area 20 to be preheated. Further, a step 106 then determines if these preheatings have been completed, and if so, the process proceeds to a step 108.

In the step 108, the film F is inserted from the insertion opening 15 of the automatic developing apparatus 10 so as to initiate the process. After being washed in the washing tank 18, the film F is dried by the radiant heat of the far infrared radiant heaters 52 while simultaneously being squeezed at the squeezing portion 40.

Next, the film F is conveyed to the first drying portion 56 and dried by the radiant heat of the far infrared radiant heaters 58. Then, in a step 110, detection data is read from the surface temperature sensor 68. Further, in step 112, the target temperature C3, based on the predetermined drying control pattern, and the surface temperature C of the film F are compared with each other. If $C3 \geqq C$, the far infrared radiant heaters 58 are turned on in a step 114. If $C3 < C$, the far infrared radiant heaters 58 are turned off in a step 116. Then, the process moves on to a step 118.

In the step 118, detection data is read from the surface temperature sensor 69. Next, in a step 120, the target temperature C2 and the surface temperature C of the film F are compared with each other. If $C2 \geqq C$, the heater 66 is turned on in step 122. If $C2 < C$, the heater 66 is turned off in a step 124. The routine ends in this state. This allows the film F to be dried in a short time and further allows the film F to be dried optimally.

The drying control pattern of the present embodiment illustrated in FIG. 2 has been explained herein for a case in which the linear velocity of the film F is 2200 mm/s and the conveying distance thereof is 220 mm. However, increasing the number of the far infrared heaters 52, 58 can result in an increase, and therefore, an improvement in the linear velocity of the film F accompanied with an increase of drying speed of the film F, thereby further reducing the overall processing time of the automatic developing apparatus 10.

Finally, the developer, the fixing liquid and the film F utilized in an experiment of the present embodiment will be described further.

(1) Preparation of Fine-Grain AgI

In a solution maintained at 35° C., 0.5 g of potassium iodide and 26 g of gelatin are added to 2 liter of water. Then, 80 cc of a silver nitrate aqueous solution, containing 40 g of silver nitrate, and 80 cc of an aqueous solution, containing 39 g of potassium iodide, are added to the solution in five minutes while being agitated. In this case, the flow velocities of the silver nitrate aqueous solution and the potassium iodide aqueous solution, while being added, are each 8 cc per minute at the beginning of the addition. The flow velocities are accelerated in straight-line so as to complete the addition of 80 cc in five minutes.

After the grains are thus formed, a precipitation technique at a temperature of 35° C. removes soluble salides.

Further, in the solution of which temperature is raised to 40° C., 10.5 g of gelatin and 2.56 g of phenoxy ethanol are added. Next, the pH is adjusted to 6.8 with NaOH. The resultant emulsion has a total weight of 730 g and is composed of mono-disperse AgI fine grains having an average particle diameter of 0.015 μm.

(2) Preparation of Flat Grain

In a container maintained at 60° C. in which 4.5 g of potassium bromide, 20.6 g of gelatin, 2.5 cc of 5% aqueous solution of thioether $HO(CH_2)_2S(CH_2)_2S(CH_2)_2OH$ are added to 1 liter of water, 33 cc of an aqueous solution containing 37 cc of a silver nitrate aqueous solution (3.43 g of silver nitrate), 2.97 g of potassium bromide and 0.363 g of potassium iodide are, while being agitated, added in thirty-seven seconds by a double jet technique. Then, after an aqueous solution containing 0.9 g of potassium bromide is added, 53 cc of a silver nitrate aqueous solution (4.90 g of silver nitrate) is added in thirteen minutes at a temperature of 70° C. Further, 15 cc of a 25% ammonia aqueous solution is added. After the mixture undergoes physical-ripening for twenty minutes without the temperature being changed, 14 cc of a 100% acetic solution is added. Subsequently, an aqueous solution, which contains 133.3 g of silver nitrate, and a potassium bromide aqueous solution are added in thirty-five minutes by a control double jet technique, while the mixture is kept at a the pAg to 8.5. Then, 10 cc of 2N potassium thiocyanate solution and the AgI fine grains, which were prepared in the above process (1) are added by 0.05 mol % for the total silver amount in the mixture. After the mixture undergoes physical-ripening for five minutes without the temperature being changed, the temperature is lowered to 35° C. In this manner, the mono-disperse flat fine grains each have 0.31 mol % of the total iodine content, an average projected area diameter of 1.10 μm, a thickness of 0.165 μm, and a 18.5% coefficient of variation in diameter.

Thereafter, soluble salides are removed by a precipitation technique. Again, the temperature is raised up to 40° C. and 35 g of gelatin, 2.35 g of phenoxy ethanol, and 0.8 of polystyrene sulfonic sodium as thickener are added so that the pH value be adjusted to 5.90 and pAg be adjusted to 8.25 by means of NaOH and a silver nitrate solution.

Chemical sensitization is performed under the conditions that the temperature is kept at 56° C. while the emulsion is agitated. First, 0.043 mg of thiourea dioxide is added, and the mixture is allowed to stand for twenty-two minutes, thereby effecting a reduction sensitization. Then, 20 mg of 4-hydroxy-6-methyl-1, 3, 3a, 7 tetrazaindene and 500 mg of sensitizing dye A are added. 1.1 g of calcium chloride aqueous solution are also added. Subsequently, 3.3 mg of sodium thiosulfate, 2.6 mg of gold chloride acid and 90 mg of potassium thiocyanate are added. After forty minutes the mixture is cooled down to a temperature of 35° C.

Thus, preparation of the flat grains 1 is completed.

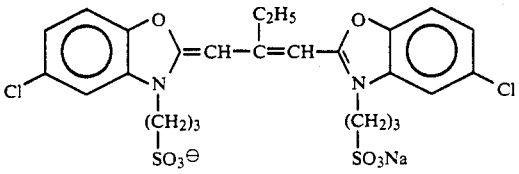

PREPARATION OF A COATING LIQUID

The following chemicals are added to the emulsion per 1 mol of silver halide in the emulsion so as to form a coating liquid.

2,6-bis(hydroxyamino)4-diethylamino-1,3,5-triazine . . . 72 mg
gelatin . . . 69 g
trimethylolpropane . . . 9 g
dextran (average molecular weight: 39,000) . . . 18.5 g
polystyrene sodium sulfonic acid (average molecular weight: 600,000) . . . 1.8 g
hardening agent 1,2-bis(vinylsulfonylacetamide) ethane The amounts added are adjusted to become a 225% swelling rate.

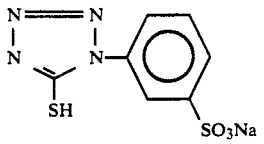

PREPARATION OF A COATING LIQUID FOR A SURFACE PROTECTIVE LAYER

The surface protective layer is adjusted for preparation so that each component contains the following amount respectively.

| Contents of the Surface Protective Layer | Amount Used for Coating |
|---|---|
| gelatin | 0.8 g/m² |
| sodium polyacryl acid (average molecular weight . . . 400,000) | 0.023 g |
| $C_8H_{17}SO_2N(C_3H_7)(CH_2CH_2O)_4(CH_2)_4SO_3Na$ | |
| polymethyl methacrylate (average particle diameter . . . 3.7 μm) | 0.087 g |
| proxel (The pH is adjusted to 6.4 with NaOH) | 0.0005 g |

PREPARATION OF A BASE (1) Preparation of Dyes D-1 for an Undercoating Layer

The following dyes are first processed by a ball mill according to the method described in Japanese Patent Application Laid-open No. 63-197943.

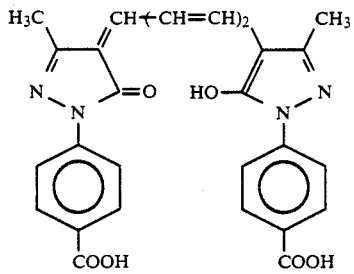

434 ml of water and 791 ml of 6.7% aqueous solution of Triton X-200$^R$ interfacial active agent (TX-200$^R$) are poured into 2 liter of a ball mill, and then 20 g of the dyes is added to this solution. 400 ml of zirconium oxide (ZrO) beads (2 mm in diameter) are added, and the mixture is ground for four days. Thereafter, 160 g of 12.5% gelatin is added thereto. After degassing, these ZrO beads are removed by filtration. According to an observation of the resulting dye dispersing substances, the particle diameter of the pulverized dyes has a wide distribution of 0.05 to 1.15 μm, and the average particle diameter is 0.37 μm.

Further, using a centrifugal separation technique, the dye beads which are greater than or equal to 0.9 μm are removed. Thus, the dye dispersing substances D-1 are obtained.

(2) Preparation of a Base

A corona discharge process is effective on the biaxial oriented polyethylene terephthalate film having a thickness of 183 μm. Then, a first undercoating liquid, which is made up of the following composition, is applied to the film by a wire bar coater so that the amount of coating is 5.1 cc/m². The film is dried for one minute at 175° C.

Further, a first undercoating layer is provided on the opposite side of the film by effecting the same process.

The polyethylene terephthalate used contains 0.04 wt % of the dyes composed of the following structure.

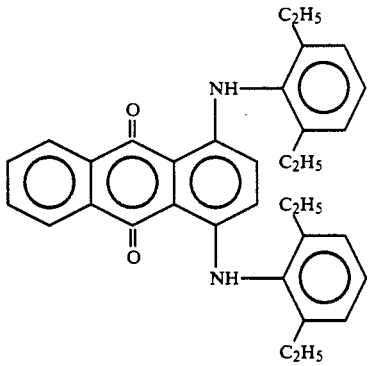

A second undercoating liquid of the following composition is applied and dried by a wire bar coater system at 150° C. to both sides of the first undercoating layer one side at a time so that the amount of the second undercoating liquid to be applied should be as follows.

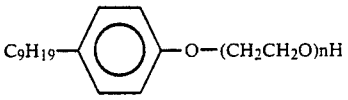

(n = 8.5)

PREPARATION OF A PHOTOGRAPHIC MATERIAL

The emulsion and the surface protective layer are applied to both sides of the transparent base materials described above by a simultaneous extrusion method. The amount of silver to be applied to one side is 1.7 g/m$^2$.

Thus, the photographic material 1 is obtained.

When this photographic material has been kept for seven days at 25° C. and at an RH of 60%, the swelling rate of the hydraulic colloid layer is measured. The thickness of a drying membrane (a) is obtained by viewing any section therein with a scanning electron microscope. The swelling membrane (b) is obtained by freeze-drying the photographic material with liquid nitrogen, under the conditions that the photosensitive material is immersed in distilled water at a temperature of 21° C. for three minutes, and by observing the photosensitive material with a scanning electron microscope.

When the swelling rate is obtained by the following expression, the photographic material has a 225% swelling rate.

$$\text{Swelling rate } (\%) = [\{(b)-(a)\}/(a)] \times 100.$$

The resulting photographic material, after being exposed, is processed by the automatic developing apparatus as follows:

| <Concentrated liquid developer> | |
|---|---|
| potassium hydroxide | 56.6 g |
| sodium sulfite | 200 g |
| diethylenetriamine-pentaacetic acid | 6.7 g |
| potassium carbonate | 16.7 g |
| boric acid | 10 g |

-continued

| | |
|---|---|
| hydroquinone | 83.3 g |
| diethyleneglycol | 40 g |
| 4-hydroxymethyl-4-methyl-1-phenyl-3-pyrazolidone | 22.0 g |
| 5-methylbenzotriazol | 2 g |
| 11 with water (The pH value is adjusted to 10.60). | |
| <Concentrated liquid fixer> | |
| ammonium thiosulfate | 560 g |
| sodium sulfite | 60 g |
| ethylene diamine tetraacetic acid-disodium-dihydrate | 0.10 g |
| sodium hydroxide | 24 g |
| 11 with water (The pH value is adjusted to 5.10 with acetic acid). | |

When starting the developing process, each tank of the automatic developing liquid is filled with the respective following processing liquid.

The developing tank: By adding 10 ml of a starter, which contains 2 g of potassium bromide and 1.8 g of acetic acid, to 333 ml of the concentrated liquid developer made up of the above composition and to, 667 ml of water, the pH value is adjusted to 10.25.

The fixing tank: 250 ml of the concentrated liquid fixer made up of the above composition and 750 ml of water Dry-to-try processing is performed for thirty seconds. The washing water is made to flow at a rate of 31 per minute only when the film is passing through. At other times, the flow of the washing water is stopped. The replenishing amounts and the processing temperatures of the developer and the fixing liquid are respectively as follows:

| | Temperature | Replenishing amount |
|---|---|---|
| *Developing | 35° C. | 20 ml/10 × 12 inches |
| *Fixing | 32° C. | 30 ml/10 × 12 inches |
| *Washing | 20° C. | 31/one minute |
| *Drying | 55° C. | |

Further, when the present invention is implemented using the film and the processing liquid having the following respective structures, drying can be performed optimally in the same quick manner as above.

(1) Preparation of Emulsion

| Emulsion A | |
|---|---|
| First liquid | |
| water | 11 |
| gelatin (photographic inert type) | 20 g |
| KBr | 5 g |
| 1.3-dimethylimidazolidine-2-thione | 20 mg |
| sodium benzenethiosulfonate | 8 mg |
| Second liquid | |
| water | 400 cc |
| silver nitrate | 100 g |
| Third liquid | |
| water | 400 cc |
| KBr | 75 g |
| potassium hexachloro-iridium (III) | 0.018 mg |

The second liquid and the third liquid are simultaneously added, for twelve minutes, while being agitated, to the first liquid, which is maintained at 40° C. and at a pH of 4.5. Nuclear grains of 0.15 μm are formed. Subsequently, the following fourth and fifth liquids are mixed in simultaneously for twenty minutes.

| | |
|---|---|
| Fourth liquid | |
| water | 400 cc |
| silver nitrate | 100 g |
| Fifth liquid | |
| water | 400 cc |
| KBr | 70 g |

Thereafter, the film is washed by a flocculation technique according to a conventional method. A photographic inert-type gelatin is added thereto. Then, chemical sensitization is performed by adjusting the pH to 5.2 and the pAg to 7.5 and adding 8 mg of sodium thiosulfate and 12 mg of chloroauric acid, so as to obtain an optimum ratio of fog to sensitivity at 65° C. Further, 200 mg of 4-hydroxy-6-methyl-1,3,3a,7-tetrazaindene is added as a stabilizer, and phenoxyethanol is added as a preservative.

As a result, a mono-disperse cubic emulsion of pure silver bromide having an average particle diameter of 0.25 μm is obtained (12% coefficient of variation).

| Emulsion B | |
|---|---|
| First liquid | |
| water | 1.01 |
| gelatin | 20 g |
| sodium chloride | 5 g |
| 1.3-dimethylimidazolizine-2-thione | 20 mg |
| sodium benzenesulfonate | 8 mg |
| Second liquid | |
| water | 400 ml |
| silver nitrate | 100 g |
| Third liquid | |
| water | 400 ml |
| sodium chloride | 36.6 g |
| potassium bromide | 28 g |
| potassium hexachloro-iridium (III) | 0.018 mg |

The second liquid and the third liquid are, while being stirred, simultaneously added for ten minutes to the first liquid maintained at 38° C. a pH of 4.5, so as to form nuclear grains of 0.161 μm. Subsequently, the following fourth and fifth liquids are added simultaneously for ten minutes.

| | |
|---|---|
| Fourth liquid | |
| water | 400 ml |
| silver nitrate | 100 g |
| Fifth liquid | |
| water | 400 ml |
| sodium chloride | 36.6 g |
| potassium bromide | 28 g |

Thereafter, washing and chemical sensitization are performed in the same manner as in the preparation of emulsion A. Then, a stabilizer and a preservative are added thereto.

Finally, the resulting salt silver bromide mono-disperse cubic emulsion (having a 9% coefficient of variation) of a 0.20 μm average particle diameter, containing 60 mol % of silver chloride is obtained.

EMULSION C

Grains are formed in the same manner as that described in the case of Emulsion B except that $3\times10^{-5}$ mol/Ag mol of $K_4Fe(CN)_6$ and $5\times10^{-7}$ mol/Ag mol of $(NH_4)_3RhCl_6$ are added to the above-described five types of liquids. Thereafter, the process of washing, chemical sensitizing and adding additives are performed in the same manner as in emulsions A and B. The resulting salt silver bromide cubic emulsion (having a 9% coefficient of variation) containing 60 mol % of silver chloride is thereby obtained.

(2) Preparation of a Photographic Material 30 ml/mol Ag of the infrared sensitizing dyes is added to the prepared emulsions A, B and C so as to effect an infrared sensitization. Further, for the purposes of supersensitization and stabilization, 300 mg of 4,4'-bis(4,6-dinaphtoxy-pyrimidine-2-ilamino)-disodium salt stilbenedisulfonate and 450 mg of 2,5-dimethyl-3-allylbenzothiazol iodo salt are respectively added per one mol of silver.

Further, 100 mg/m² of hydroquinone, 25% of polyethylacrylate latex with respect to gelatin binder, and 86 mg/m² of 2-bis(vinylsulfonylacetamide)ethan as a hardening agent are added and applied together with gelatin, so that the total gelatin content amounts to 2.0 g/m², onto a polyester base.

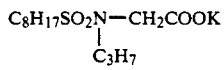

In this case, 0.5 g/m² of gelatin as a protective layer above the emulsion layer, 20 mg/m² of the dye made up of the following structural formula (2), 60 mg/m² of polymethyl methacrylate having a particle diameter of 2.5 μm as matt material, 70 mg/m² of colloidal silica having a particle diameter of 10 μm, and sodium salt dodecylbenzene sulfonate and an interfacial active agent containing fluorine made up of the following structural formula (2) as coating aids are applied at the same time that the emulsion layer is applied.

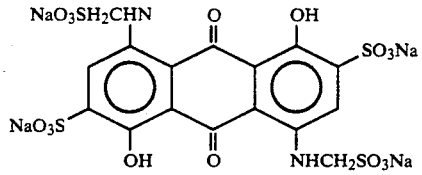

The base according to this embodiment of the present invention has a backing layer and a backing protective layer made of the following compositions.

| | |
|---|---|
| [Backing Layer] | |
| gelatin | 2.0 g/m² |
| sodium dodecylbenzenesulfonate | 80 mg/m² |
| Dye (3) | 70 mg/m² |
| Dye (4) | 70 mg/m² |
| Dye (5) | 90 mg/m² |
| 1,3-divinylsulfone-2-propanol | 60 mg/m² |
| [Backing protective layer] | |
| gelatin | 0.5 g/m² |

-continued

| | |
|---|---|
| polymethylmethacrylate (particle size: 4.7 μm) | 30 mg/m$^2$ |
| sodium dodecylbenzenesulfonate | 20 mg/m$^2$ |
| interfacial active agent containing fluorine (the above formula ① ) | 2 mg/m$^2$ |
| silicone oil | 100 mg/m$^2$ |

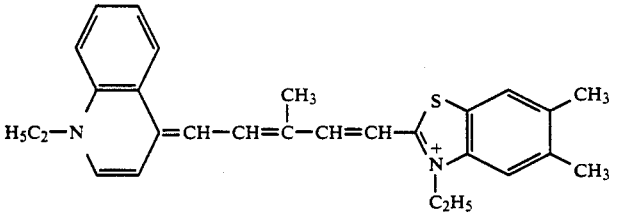

When this photographic material has been kept for seven days at a temperature of 25° C. and at an RH of 60%, the swelling rate of the hydraulic colloid layer thereof is measured. The thickness of a drying membrane (a) is obtained by viewing any section therein with a scanning electron microscope. The swelling membrane (b) is obtained by freeze-drying the photographic material, with the photographic material immersed in distilled water at a temperature of 21° C. for three minutes, with liquid nitrogen, and then observing the swelling membrane with a scanning electron microscope.

According to the following expression, the swelling rate of the emulsion layer of the sample according to the present invention ranges from 90% to 110%, while that of the backing layer ranges from 70% to 90%.

$$\text{Swelling rate } (\%) = [\{(b)-(a)\}/(a)] \times 100.$$

The resulting photographic material, after being exposed, is processed by the automatic developing apparatus FG-710NH manufactured by Fuji Photo Film Co., Ltd. at the temperatures and times listed below. The developer α and the fixing liquid β, which are used, are as follows.

| | | |
|---|---|---|
| *developing | 38° C. | 14 seconds |
| *fixing | 37° C. | 9.7 seconds |
| *washing | 26° C. | 9 seconds |
| *squeezing | | 2.4 seconds |
| *drying | 55° C. | 8.3 seconds |
| TOTAL | | 43.4 seconds |

| [Developer α] | |
|---|---|
| hydroquinone | 25.0 g |
| 4-methyl-4-hydroxymethyl-1-phenyl-3-pyrazolidone | 0.5 g |
| potassium sulfite | 90.0 g |
| 2 sodium ethylene diamine tetraacetate | 2.0 g |
| potassium bromide | 5.0 g |
| 5-methylbenzotriazole | 0.2 g |
| 2-methyl mercapto imidazole-5-sulfonate | 0.3 g |
| sodium carbonate | 20 g |
| water | 1 liter |
| (The pH value is adjusted to 10.6 with sodium hydroxide.) | |

| [Fixing liquid β] | |
|---|---|
| ammonium thiosulfate | 210 g |
| sodium sulfite (absolute) | 20 g |

-continued

| | |
|---|---|
| 2 sodium ethylenediaminetetraacetate | 0.1 g |
| glacial acetic acid | 15 g |
| water | 1 liter |
| (The pH value is adjusted to 4.8 with ammonia water.) | |

In this embodiment of the present invention, the film F is discharged from the automatic developing apparatus 10 after a predetermined time passes after the surface temperature of the film F reaches the temperature C2 at the drying point D. However, the film F may be discharged immediately after the surface temperature thereof reaches the temperature C2 at the drying point D.

What is claimed is:

1. A drying device for an automatic developing apparatus, having a drying area for drying a photosensitive material which has been processed by a processing liquid in a processing area, said photosensitive material including opposite surfaces, said drying device comprising:

a squeezing portion, located at an upstream side of said drying area, comprising a squeezing means for squeezing water remaining on at least one of the surfaces of said photosensitive material and a heating means for radiating radiant heat to said photosensitive material while said photosensitive material is being squeezed; and a first drying means, located in said drying area, for radiating radiant heat to said photosensitive material which has passed through said squeezing portion.

2. A drying device for an automatic developing apparatus according to claim 1, wherein said heating means in said squeezing portion and said first drying means both comprise a plurality of far infrared radiant heaters, located on both sides of a conveying path of said photosensitive material, for radiating radiant heat.

3. A drying device for an automatic developing apparatus according to claim 2, further comprising a plurality of fans blowing drying air uniformly to surfaces of said photosensitive material at sides opposite to radiating directions of said plurality of far infrared radiant heaters.

4. A drying device for an automatic developing apparatus according to claim 1, wherein said drying area comprises:

a first drying section having a first drying means comprising a plurality of far infrared radiant heaters for radiating radiant heat; and a second drying section having a second drying means comprising a plurality of air nozzles for blowing drying air to both of the surfaces of said photosensitive material.

5. A drying device for an automatic developing apparatus according to claim 4, further comprising:

a first surface temperature sensor means for sensing a surface temperature of said photosensitive material in said first drying section;

a second surface temperature sensor means for sensing a surface temperature of said photosensitive material in said second drying section; and a control means for controlling said first drying means and said second drying means, wherein said photosensitive material is dried to a state in a decreasing-rate drying region within said first drying section.

6. A drying device for an automatic developing apparatus having a drying area including a first drying section and a second drying section for successively drying a photosensitive material, said photosensitive material including opposite surfaces, said drying device comprising:

a squeezing portion located at an upstream side of said drying area, comprising a squeezing means for squeezing water remaining on at least one of the surfaces of said photosensitive material and a heating means having a plurality of far infrared radiant heaters for radiating radiant heat onto said photosensitive material;

a transporting means for transporting said photosensitive material through said squeezing portion, said first drying section and said second drying section;

a plurality of air nozzles, located in said second drying section, for blowing drying air to both of the surfaces of said photosensitive material;

a first surface temperature sensor means for sensing a surface temperature of said photosensitive material in said first drying section;

a second surface temperature sensor means for sensing a surface temperature of said photosensitive material in said second drying section; and a control means for controlling said plurality of far infrared radiant heaters in said squeezing portion and said first drying section, for controlling the temperature of drying air blown into said second drying section so that said photosensitive material is dried to a state in a decreasing-rate drying region in between a constant-rate drying region and a drying point by said plurality of far infrared radiant heaters within a said first drying section, and further dried to the drying point by said drying air within said second drying section.

7. A drying device for an automatic developing apparatus according to claim 6, wherein said photosensitive material is processed in a fixing liquid containing substantially no hardening agent.

* * * * *